US009709265B2

(12) United States Patent
Sutherland et al.

(10) Patent No.: US 9,709,265 B2
(45) Date of Patent: Jul. 18, 2017

(54) POROUS METAL FOAM BURNER

(71) Applicants: Brian Sutherland, Chicago, IL (US); Michael Johnson, Elmhurst, IL (US); Chakravarthy Sishtla, Plainfield, IL (US)

(72) Inventors: Brian Sutherland, Chicago, IL (US); Michael Johnson, Elmhurst, IL (US); Chakravarthy Sishtla, Plainfield, IL (US)

(73) Assignee: Gas Technology Institute, Des Plaines, IL (US)

( * ) Notice: Subject to any disclaimer, the term of this patent is extended or adjusted under 35 U.S.C. 154(b) by 296 days.

(21) Appl. No.: 14/200,567

(22) Filed: Mar. 7, 2014

(65) Prior Publication Data

US 2015/0253005 A1 Sep. 10, 2015

(51) Int. Cl.

| | |
|---|---|
| ***F23C 99/00*** | (2006.01) |
| ***F23D 14/16*** | (2006.01) |
| *F23C 7/00* | (2006.01) |

(52) U.S. Cl.

CPC ..... *F23D 14/16* (2013.01); *F23C 99/006* (2013.01); *F23C 7/00* (2013.01); *F23C 99/00* (2013.01)

(58) Field of Classification Search

CPC ..... F23D 14/02; F23D 14/16; F23C 99/00; F23C 7/00

USPC ..... 431/328, 11, 7; 126/609; 60/39.36

See application file for complete search history.

(56) References Cited

U.S. PATENT DOCUMENTS

| | | | | | |
|---|---|---|---|---|---|
| 4,519,770 | A * | 5/1985 | Kesselring | F23D 14/18 | 122/4 D |
| 4,746,287 | A * | 5/1988 | Lannutti | B28B 19/0038 | 264/256 |
| 5,370,529 | A * | 12/1994 | Lu | F24H 3/065 | 126/116 R |
| 5,470,222 | A * | 11/1995 | Holowczak | C04B 38/00 | 431/328 |
| 5,476,375 | A * | 12/1995 | Khinkis | F23C 6/045 | 122/18.4 |
| 6,183,241 | B1 * | 2/2001 | Bohn | F23D 14/16 | 122/DIG. 3 |
| 2003/0136398 | A1 * | 7/2003 | Mehos | F02G 1/043 | 126/609 |
| 2008/0031800 | A1 | 2/2008 | Franz et al. | | |
| 2013/0330676 | A1 | 12/2013 | Park | | |
| 2015/0330625 | A1 * | 11/2015 | Karkow | F23D 14/58 | 431/7 |

FOREIGN PATENT DOCUMENTS

| | | | | |
|---|---|---|---|---|
| DE | 195 27 583 A1 | | 1/1997 | |
| DE | 195 44 417 A1 | | 6/1997 | |
| DE | 102004012988 | * | 10/2005 | F22B 31/00 |

* cited by examiner

*Primary Examiner* — Gregory Huson
*Assistant Examiner* — Nikhil Mashruwala
(74) *Attorney, Agent, or Firm* — Pauley Erickson & Kottis

(57) ABSTRACT

A gas burner including a gas distribution element and a metal foam matrix burner covering the distribution element. A heat sink partially surrounds, and is spaced apart from, the metal foam matrix. The heat sink has an open end to vent exhaust emissions. The gas burner provides reduced nitrous oxide and carbon monoxide emissions and effective heat transfer modes (conduction, convection and radiation) compared to state-of-the-art burner technologies.

18 Claims, 1 Drawing Sheet

POROUS METAL FOAM BURNER

BACKGROUND OF THE INVENTION

Field of the Invention

This invention relates to natural gas burners, such as for a gas fired, fan-type furnace, and more particularly to a low $NO_x$ and/or CO emission burner for gas fired applications.

Description of Related Art

Residential furnaces generally use open flame "inshot" style burners that are typically capable of achieving $NO_x$ emissions of just about 40 ng/J. Modifications to the inlet of an inshot burner and the induced draft blower has achieved just under 20 ng/J, but going lower has been found to dramatically increase carbon monoxide emissions. There is a continuing need for an improved gas burner that provides efficient combustion and lower emissions.

SUMMARY OF THE INVENTION

This invention provides a burner design for residential furnaces, or other suitable applications, that achieves low nitrogen oxide ($NO_x$) emissions, such as less than about 14 ng/J, and low CO emissions, such as less than about 50 ppm, without changing the basic design of the furnace. The burner of this invention includes a metal foam matrix serving as a combustion medium, with combustion occurring within or fully on the surface of the medium. The burner is characterized by high radiation heat transfer, a wide operating range, even heat transfer and flame temperatures, as well as increased flame stability with lower combustion zone temperatures, which leads to a reduction in $NO_x$ and CO formations. The reaction time for combustion during perfusion of the air/fuel mixture through the fine porous metal foam is too low for $NO_x$ production. Also the temperature in the porous combustor is lower than in the center of an open flame as a result of the uniform combustion process and the heat radiating off the metal foam, which counteracts the production of $NO_x$.

Embodiments of this invention provide a natural gas burner including a metal foam matrix burner and an air/fuel distribution element disposed within the metal foam matrix burner. In particular embodiments, the natural gas burner includes an air/fuel distribution tube including an outer surface and a plurality of gas openings. In additional embodiments, the air/fuel distribution tube is itself formed of a porous metal foam medium similar to the metal foam burner, however having characteristics which inhibit combustion. A metal foam matrix burner is disposed on, and desirably covering, the outer surface of the distribution element, and a heat sink partially surrounds the metal foam matrix.

In one embodiment of this invention, the gas burner includes a cylindrical air/fuel distribution tube including a fuel/air inlet at a first end, a closed or capped second end opposite the first end, and an outer surface including a plurality of air/fuel openings. A metal foam matrix burner covers the outer surface of the air/fuel distribution tube, and a cylindrical sleeve partially surrounds the metal foam matrix. In another embodiment of this invention, the distribution tube is formed of a porous medium similar in nature to the metal foam matrix burner, however having characteristics resulting in a Peclet number of less than 65. A metal foam matrix burner covers the outer surface, with both the burner and distribution matrices sintered together. For both of these embodiments, a sleeve partially surrounds the metal foam matrix. The sleeve is spaced apart from the foam matrix and has an open end adjacent to the second end of the gas distribution tube.

The invention provides a glowing metal foam burner, which provides a higher degree of infrared radiation due to combustion fully occurring within the body or on the surface of the metal foam matrix. The resulting burner results in low $NO_x$ and CO emissions. Additionally, complex burner geometries, which are not feasible with conventional state of the art combustion techniques, are possible.

BRIEF DESCRIPTION OF THE DRAWINGS

These and other objects and features of this invention will be better understood from the following detailed description taken in conjunction with the drawings.

DESCRIPTION OF THE PRESENTLY PREFERRED EMBODIMENTS

Figure 1:
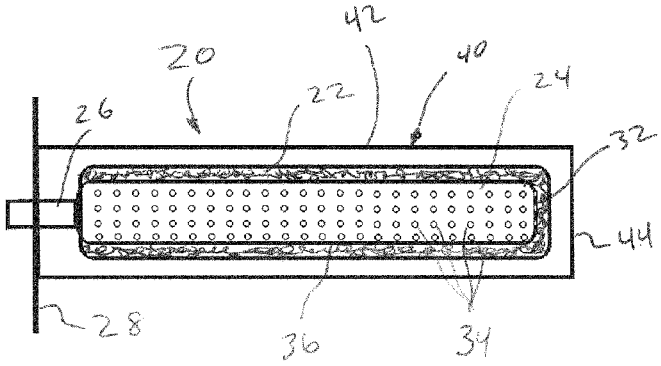
FIG. 1 is a sectional view of a gas burner according to one embodiment of this invention.
Figure 2:
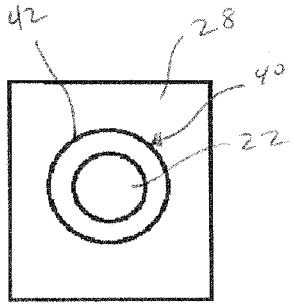
FIG. 2 is an end view of the gas burner of FIG. 1.

FIGS. 1 and 2 illustrate a gas burner 20 according to one embodiment of this invention. The burner 20 includes a metal foam matrix burner 22 and an air/fuel distribution tube 24 disposed within the metal foam burner 22. The burner 20 further includes a gas/air inlet 26 and an attachment plate 28 for attaching to a furnace structure.

The distribution tube 24 and the foam matrix 22 can have any suitable size, shape and configuration, depending on need. The metal foam 22 can be formed in a wide array of shapes and sizes, for use as a medium in a wide variety of applications. In FIGS. 1 and 2, the distribution tube 24 is a cylindrical tube with the inlet 26 at one end and a closed or covered second end 32 opposite the inlet 26. Any suitable shape, such as a rectangular or polygonal cross-section, is available for the distribution tube and burner. The distribution tube 24 includes a plurality of gas openings 34 extending through the tube 24, also having any suitable size, shape and configuration or pattern, through which the gas/air mixture exists the tube 24 into the foam matrix 22.

Figure 3:
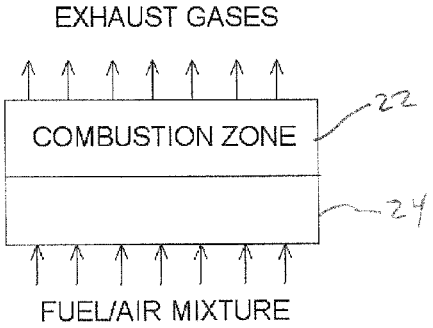
FIG. 3 schematically illustrates combustion in a burner according to embodiments of this invention.

The metal foam matrix 22 desirably covers an outer surface 36 of the distribution tube 24. In FIGS. 1 and 2, the second end 32 includes gas openings 34 and the foam matrix 22 covers the second end as well. Flame propagation of the gas burner 20 occurs within pores of the metal foam matrix burner 22, as illustrated by FIG. 3. FIG. 3 shows a gas/air distribution zone in the distribution tube 24, and the actual combustion zone in the metal foam matrix 22. The openings 34 of the distribution tube 24 are designed in such a way that flame propagation is not possible, thereby reducing or eliminating any flashback.

The pore properties of the foam matrix burner structure allow for flame propagation. Modification of pore size can dictate the combustion location within the medium. Additionally, the porous foam matrix 22 resists the gas/air mixture flow, resulting in reduction or elimination of flame lift-off Pore size for the air/fuel distribution and combustion zones is dictated by the dimension-less Peclet (Pe) number. Combustion is prevented for a porous medium when the associated Peclet number is below 65, while combustion is promoted within the porous medium when the Peclet number is at or above 65. Therefore, the pore size and characteristics of a porous air/fuel distribution is sized so an associated Peclet number of less than 65 is realized to inhibit combustion and flame flash-back, while the pores and characteristics of the metal foam burner are sized so the associated Peclet number is at or above 65. Additionally, sufficient density of the metal foam is necessary for internal combustion and to prevent flame lift-off. The pores of the foam structure of the foam matrix are large enough so that flame propagation occurs within the foam matrix.

Metals or alloys that can be reduced to a powder form can be made into a metal foam or porous metal product suitable for use in this invention. Advantages of metal foam include its low density, high strength structure, and lower combustion temperature compared to ceramic foams at a given firing rate. Metal is also not subject to the mechanical strength and thermal shock limitations of ceramic, cellular and/or reticulated materials. Low thermal inertia allows for faster transfer of heat energy than ceramic materials. The foam material has a high surface area versus pressure drop ratio due to uniform lower densities. Pressure drop is also lower than in ceramic structures on a unit volume comparison. Examples of suitable metal foams available for use in this invention are manufactured by Porvair Advanced Materials, Inc. (Hendersonville, N.C.).

While conventional burners only produce minimal levels of $NO_x$ and CO under certain operating conditions, the porous burner of this invention provides constant low values of these two species over the entire operating range. This is due, at least in part, to the total air/fuel premix and extremely quick volumetric combustion. The reaction time during the perfusion of the fine porous structure is too low for $NO_x$ production and the temperature in the porous combustor is evenly distributed, resulting in temperature lower than in the center of an open flame, which counteracts the production of $NO_x$. Additionally, the high level of radiation as a heat transfer mechanism lends for lower combustion temperature, further counteracting $NO_x$ production. Regarding CO, a highly turbulent reaction takes place in the porous structure, allowing for complete oxidation of species. Additionally, with proper design the combustion medium stays within a temperature range high enough to encourage CO oxidation, while below the temperature where $NO_x$ formation significantly occurs. The pre-mixed air/fuel mixture passes through the burning porous structure at constant, universally stable temperature with no cool areas for incomplete combustion, as in the outer area of a conventional open flame where CO production occurs. In one embodiment of this invention, the gas burner has a nitrous oxide emission that is less than about 14 ng/J, preferably at about 12 ng/J or less, and desirably at about 10 ng/J or less, and a carbon monoxide emission that is less than about 50 ppm, preferably less than about 20 ppm, more preferably less than about 15 ppm, and desirably at about 10 ppm or less. As will be appreciated by those skilled in the art, emission values are variable, and in one embodiment of this invention, the above emission values represent a mean or median of the emissions for the corresponding burner.

In one embodiment of this invention, as shown in FIGS. 1 and 2, a heat sink 40 partially surrounds the metal foam matrix 22. The heat sink radiates heat back to the foam burner 22 during combustion, further promoting uniform temperature distribution, resulting in a reduction of $NO_x$ and CO emissions while also lending itself to reducing the metal foam burner temperature through the use of radiative heat transfer. Additionally, the heat sink reduces or eliminates flame lift-off potential over a wider range of firing rates compared to the metal foam burner alone. In the particular embodiment of FIGS. 1 and 2, the heat sink 40 is embodied as a cylindrical metal sleeve 42 partially surrounding and spaced apart from the metal foam matrix 22. The cylindrical sleeve 42 is solid and has an open end 44 disposed at or near, and desirably extending beyond, the second end 32 of the gas distribution tube 24 to allow venting of exhaust gases.

Both radiation and convection play a key role as heat exchange mechanisms, providing a unique and beneficial method of combusting natural gas in particular applications, compared to conventional burner technologies which have limited radiative properties. The burner of this invention provides consistent, controlled flame propagation with lower $NO_x$ and CO emissions. The use of metal foams allows for producing burners of different sizes and shapes, allowing for implementation in a wide variety of residential furnaces, as well as other applications.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A low nitrogen oxide and low carbon monoxide gas burner, comprising:

a metal foam matrix burner;

an air/fuel distribution tube disposed within the metal foam matrix burner; and a heat sink partially surrounding and spaced apart from the metal foam matrix, wherein the heat sink is adapted to radiate heat back to the metal foam matrix burner; wherein the metal foam matrix burner and the heat sink provide a nitrogen oxide emission of less than 14 ng/J and a carbon monoxide emission of less than 50 ppm.

2. The gas burner of claim 1, wherein flame propagation occurs within pores of the metal foam matrix burner.

3. The gas burner of claim 1, wherein the metal foam matrix burner and the heat sink provide a carbon monoxide emission of less than 15 ppm.

4. The gas burner of claim 1, wherein the heat sink comprises an open end.

5. The gas burner of claim 1, wherein the heat sink comprises a metal sleeve.

6. The gas burner of claim 1, wherein the distribution tube comprises a plurality of spaced apart gas openings.

7. The gas burner of claim 6, wherein the gas distribution tube is cylindrical.

8. The gas burner of claim 6, wherein a pore size of the metal foam matrix provides a Peclet number that is greater than a Peclet number of the gas distribution tube.

9. The gas burner of claim 1, wherein a pore size of the metal foam matrix burner provides a Peclet number at or above 65.

10. The gas burner of claim 1, wherein the distribution tube comprises a porous metal foam.

11. The gas burner of claim 10, wherein a pore size of the metal foam matrix burner provides a Peclet number that is greater than a Peclet number of the distribution tube.

12. The gas burner of claim 10, wherein a pore size of the metal foam matrix burner provides a Peclet number at or above 65 and the pore size of the distribution tube provides a Peclet number that is below 65.

13. A low nitrogen oxide and low carbon monoxide gas burner, comprising:

an air/fuel distribution tube including an outer surface and a plurality of air/fuel openings;

a metal foam matrix burner disposed on the outer surface; and a heat sink partially surrounding and spaced apart from the metal foam matrix, wherein the heat sink is adapted to radiate heat back to the metal foam matrix burner whereby the gas burner has a nitrogen oxide emission of less than 14 ng/J and a carbon monoxide emission of less than 50 ppm.

14. The gas burner of claim 13, wherein the heat sink comprises a metal sleeve having an open end.

15. The gas burner of claim 13, wherein flame propagation occurs within pores of the metal foam matrix burner.

16. A low nitrogen oxide and low carbon monoxide gas burner, comprising:

a distribution tube including a gas/air inlet at a first end, a capped second end opposite the first end, and an outer surface including a plurality of gas openings, wherein the plurality of gas openings is arranged in a predetermined pattern along a length of the distribution tube with each gas opening spaced apart from adjacent gas openings;

a metal foam matrix burner covering the outer surface; and a sleeve partially surrounding and spaced apart from the metal foam matrix, the sleeve having an open end adjacent the second end of the gas distribution tube, wherein the sleeve is adapted to radiate heat back to the metal foam matrix burner; wherein the gas burner has a nitrogen oxide emission of less than 14 ng/J and a carbon monoxide emission of less than 50 ppm.

17. The gas burner of claim 16, wherein the gas burner is an open flame inshot burner.

18. The gas burner of claim 16, wherein the distribution tube is not a metal foam.

* * * * *